United States Patent [19]

Akita

[11] Patent Number: 4,995,750

[45] Date of Patent: Feb. 26, 1991

[54] CLIP-OPERATED RETRACTION MECHANISM

[75] Inventor: Yukihiro Akita, Honjo, Japan

[73] Assignee: Kabushiki Kaisha Pilot, Tokyo, Japan

[21] Appl. No.: 515,099

[22] Filed: Apr. 26, 1990

[30] Foreign Application Priority Data

Nov. 24, 1989 [JP] Japan ..... 64-136377
Jan. 17, 1990 [JP] Japan ..... 65-2994

[51] Int. Cl.[5] ..... B43K 24/04; B43K 24/08; B43K 25/00; B43K 7/12

[52] U.S. Cl. ..... 401/104; 401/106; 401/194

[58] Field of Search ..... 401/104, 105, 106, 109, 401/194

[56] References Cited

U.S. PATENT DOCUMENTS 3,652,172 3/1972 Zepell ..... 401/106

FOREIGN PATENT DOCUMENTS 61-10759 7/1986 Japan .
62-5986 1/1987 Japan .

*Primary Examiner*—Steven A. Bratlie
*Attorney, Agent, or Firm*—Ladas & Parry

[57] ABSTRACT

A writing instrument has a bush button affixed to a reservoir for moving the same from a retracted to a writing position against the force of a spring within a tubular body. The push button has a resilient cantilever secured thereto and extending longitudinally of the body. Formed on a distal end of the cantiliver, a fulcrum extends therefrom in a radially outward direction of the body through a clearance slot therein and is joined to a pocket clip. A catch on the pocket clip is urged against the body by virtue of the resiliency of the cantilever for positively engaging the body when the reservoir is moved from the retracted to the writing position. Preferably, a spring may be mounted to the push button for resiliently supporting the fulcrum in coaction with the cantiliver.

12 Claims, 4 Drawing Sheets

CLIP-OPERATED RETRACTION MECHANISM

BACKGROUND OF THE INVENTION

This invention relates generally to writing or marking instruments, and particularly to those of the kind having a writing tip retractable into the body of the instrument when it is not in use. More particularly, the invention deals with improvements in a clip-operated retraction mechanism for such writing instruments.

Japanese Unexamined Utility Model Nos. 61-107590 and 62-5986 are hereby cited as teaching retractable-tip writing instruments of simplified construction to which the present invention bears particular pertinence. Basically, these prior art devices are akin in having a pocket clip formed in one piece with a push button via a fulcrum or flexible joint. The clip fulcrum takes the form of a short pin, with a constriction formed at its midpoint, extending through a clearance slot in the substantially tubular body of the instrument. The push button is affixed to one end of an ink reservoir which has a writing tip at the other end and which is mounted within the body for movement in its longitudinal direction. The reservoir is sprung with respect to the body in a direction away from the tip.

Constituting the retraction mechanism of this prior art device is the pocket clip which has a catch formed thereon. The catch plunges into a recess in the body when the push button is pressed against the bias of the spring. The reservoir is then locked in the writing position with respect to the body.

This known type or retraction mechanism has had some inherent weaknesses in connection with the fulcrum integrally joining the clip to the push button. The fulcrum has had to coact with the clip to urge the catch against the body, in order that the catch may infallibly fall into the recess in the body when the push button is pressed. Additionally, the fulcrum has had to permit the clip to be manually pivoted thereon for the movement of the catch into and out of the recess.

Thus the fulcrum has had to perform two contradictory functions. One is as a resilient joint urging the catch against the body. The other is as a pivot about which the clip is turned for the movement of the catch into and out of the recess in the body. The fulcrum has therefore been susceptible to breakage, particularly at its constricted midsection, as a result of repeated application of stresses in use of the writing instrument. The fulcrum has been all the more prone to breakage as it has had to serve the additional purpose of preventing the angular displacement of the push button when it is pressed, by sliding along the edges of the body bounding the slot therein.

SUMMARY OF THE INVENTION

The present invention teaches, in a clip-operated retraction mechanism for writing instruments of the kind defined, how to fulcrum the pocket clip for the fulfillment of the noted contradictory requirements without the shortcomings of the prior art.

Briefly, the invention may be summarized as retraction mechanism for a retractable-tip writing instrument of the type having a reservoir which is mounted within a substantially tubular body for movement between a writing and a retracted position and which is sprung with respect to the body from the writing toward the retracted position. The retraction mechanism comprises a cantilever of resilient material secured at one end to a push button which si affixed to the reservoir for joint movement therewith between the writing and the retracted position relative to the body. Extending in the longitudinal direction of the body, the cantilever has formed on its free end a fulcrum which extends therefrom substantially radially outwardly of the body through a clearance slot therein. A pocket clip is joined to the outer end of the fulcrum. A catch is formed on the pocket clip and urged against the body by virtue of the resiliency of the cantilever for positive engagement with the body when the push button is pressed to move the reservoir from the retracted to the writing position.

Preferably, the push button, the cantilever and the fulcrum are all of one-piece construction for the ease of manufacture and assemblage. The cantilever and the fulcrum take in combination the shape of the capital L. This L-shaped cantilever-fulcrum combination performs the functions of the conventional constricted fulcrum but distinctly differs therefrom in having no localized part susceptible to the concentrated application of stresses in use.

As desired or required, a spring may be mounted between push button and fulcrum for urging the catch against the body in coaction with the cantilever. The useful life of the cantilever-fulcrum combination will then become longer.

An additional feature of the invention resides in a guide fin formed on the push button. This guide fin is slidably engaged in a guide slot formed in the body for guiding the travel of the reservoir between the writing and the retracted position. Accordingly, the fulcrum need not act as guide and thus is protected from frictional wear.

The above and other features and advantages of this invention and the manner of realizing them will become more apparent, and the invention itself will best be understood, from a study of the following description and appended claims, with reference had to the attached drawing showing some preferred embodiment of the invention.

DESCRIPTION OF THE PREFERRED EMBODIMENTS

The present invention will now be described more specifically as embodied in the writing or marking instrument shown in its entirety in FIGS. 1 and 2. The representative instrument has a substantially tubular body 1 having a relatively small diameter opening 1*a* at one end and a relatively large diameter opening 1*b* at the other. A reservoir 2 is mounted within the body 1 for movement back and forth in its longitudinal direction.

Figure 1:
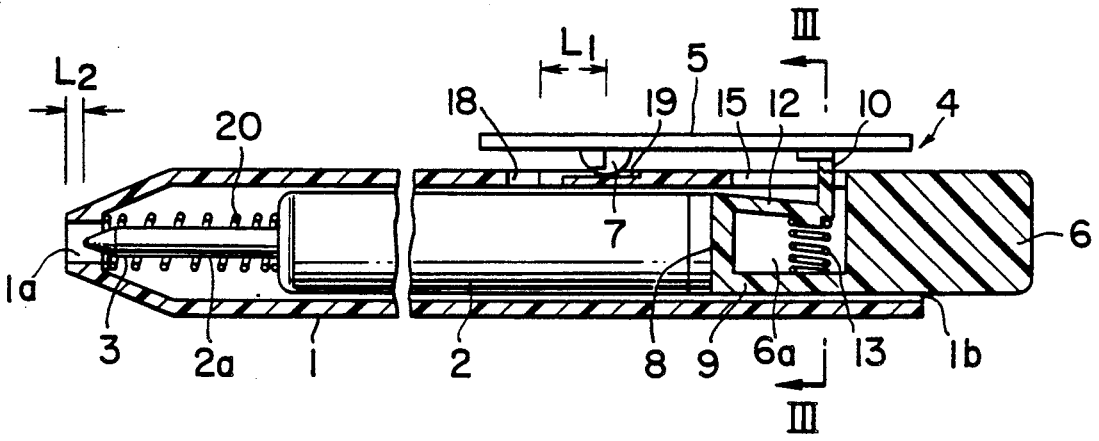
FIG. 1 is an axial section through the writing instrument embodying the principles of the present invention, with the reservoir shown in the retracted position.
Figure 2:
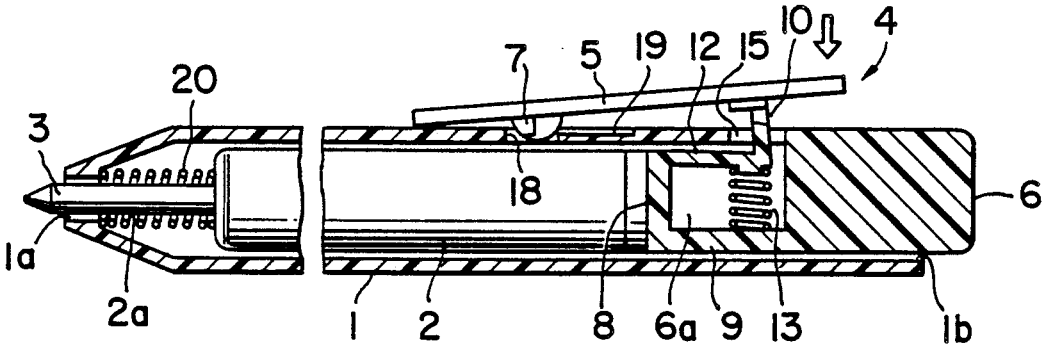
FIG. 2 is a view similar to FIG. 1 except that the reservoir is shown in the writing position.

Hereinafter in this specification the directional terms "front" and "rear", "forward" and "backward", and derivatives thereof, will be used in reference to the left hand end and right hand end ,respectively, of the body 1 as seen in FIGS. 1 and 2. Thus, for example, the smaller diameter opening 1*a* is at the front end of the body 1, and the larger diameter opening 1*b* at its rear end.

It will also be seen that the reservoir 2 has an extension 2*a* of reduced diameter extending forwardly therefrom and terminating in a tip 3. The tip 3 is situated within the body 1 when the reservoir 2 is in a retracted position as in FIG. 1, and projects out of the front end opening 1*a* of the body when the reservoir 2 is in a writing position as in FIG. 2. Coiled around the reservoir extension 2*a*, a helical compression spring 20 biases the reservoir 2 from the writing toward the retracted position.

The reference numeral 4 generally denotes the retraction mechanism of this writing instrument. Broadly, it comprises a pocket clip 5 and a push button 6 which are interrelated, both structurally and functionally, in a manner set forth hereafter.

Figure 3:
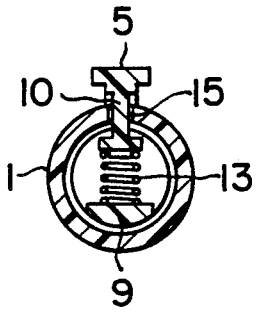
FIG. 3 is a cross section through the writing instrument, taken along the line III—III in FIG. 1.
Figure 4:
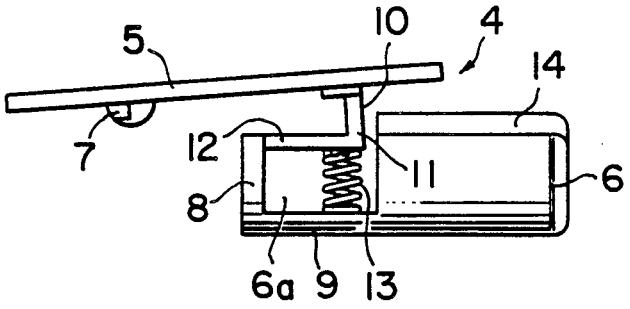
FIG. 4 is a side elevation of the retraction mechanism in the writing instrument of FIG. 1.
Figure 5:
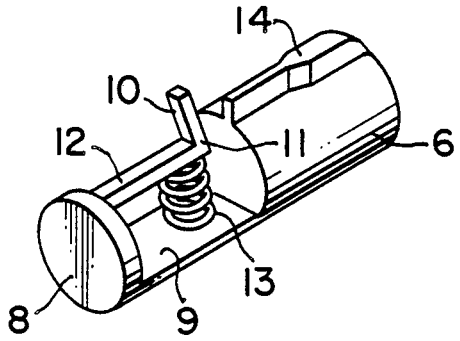
FIG. 5 is a perspective view of the retraction mechanism, the view not showing the pocket clip.

As shown also in FIGS. 3–5, the push button 6 is generally cylindrical in shape and is joined to a disklike end plate 8 via a connective strip 9. A spring chamber 6*a* is thus defined between push button 6 and end plate 8. The end plate 8 is secured to the rear end of the reservoir 2, so that the push button 6 is movable with the reservoir 2 between the retracted and writing positions.

For joining the push button 6 to the pocket clip 5, a resilient cantilever 12 extends backwardly from the periphery of the end plate 8, in a direction parallel to the axis of the body 1, and terminates short of the push button 6. A fulcrum 10 is formed on the distal end 11 of the cantilever 12 and extends radially outwardly of the body 1 through a clearance slot 15 formed therein. Disposed outside the body 1 and extending longitudinally thereof, the pocket clip 5 is secured to the outer end of the fulcrum 10 at its midpoint which is closer to its rear end than to its front end. It will therefore be understood that the cantilever 12 and fulcrum 10 constitute in combination an L-shaped support structure for the pocket clip 5, supporting the same both pivotally and resiliently.

Preferably, and as indicated in all of FIGS. 1–5, a helical compression spring 13 is mounted between connective strip 9 and cantilever 12. The spring 13 coacts with the resilient cantilever 12 to bias the pocket clip 5 with respect to the body 1, as will be later discussed in more detail.

Figure 6:
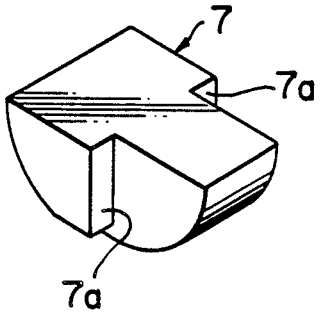
FIG. 6 is an enlarged perspective view of the catch on the pocket clip of the writing instrument of FIG. 1.

The pocket clip 5 has a catch 7 formed thereon in a position spaced backwardly from its front end. FIG. 6 is an enlarged representation of the catch 7. Approximately semicircular in shape as seen in a side view as in FIGS. 1, 2 and 4, the catch 7 has a pair of shoulders 6*a* formed on its opposite sides and extending substantially radially of the body 1.

Figure 7:
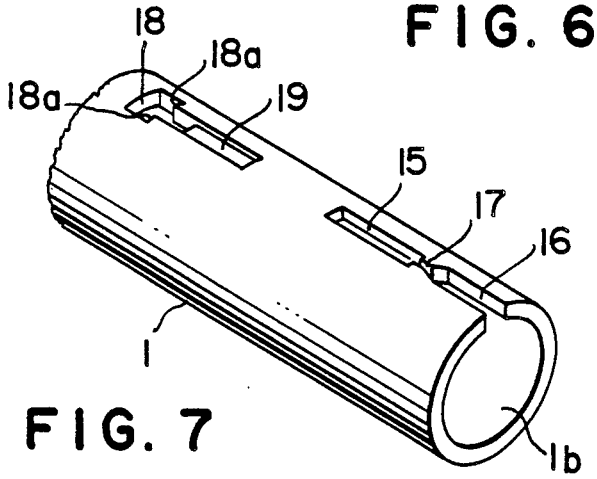
FIG. 7 is a fragmentary perspective view of the body of the writing instrument of FIG. 1.
Figure 8:
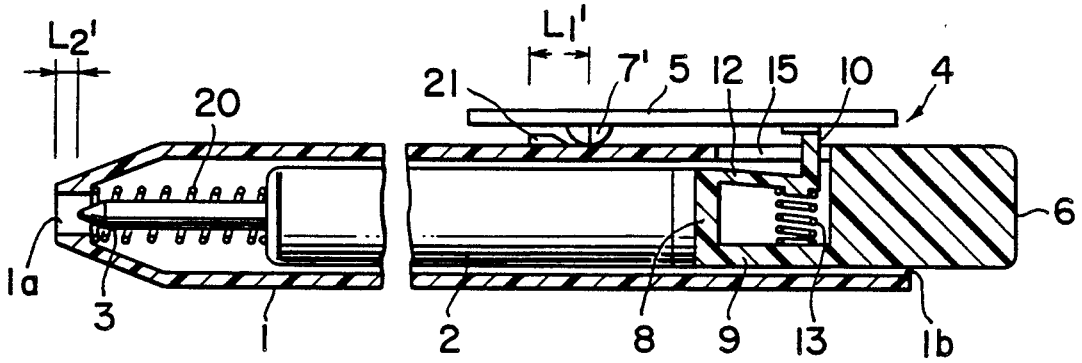
FIG. 8 is an axial section through another preferred form of writing instrument according to the present invention, with the reservoir shown in the retracted position.

As shown in both FIGS. 1 and 2 and more clearly in FIG. 7, the body 1 has a T-shaped aperture 18 formed therein in a position spaced forwardly from the clearance slot 15. The catch 7 on the pocket clip 5 is to fall into this aperture 18 when the reservoir 2 is moved to the writing position of FIG. 2 by the depression of the push button 6. The aperture 18 is bounded in part by a pair of edges 18*a* extending circumferentially of the body 1 for positive engagement with the pair of shoulders 7*a* of the catch 7.

When the reservoir 2 is in the retracted position as in FIG. 1, on the other hand, the catch 7 is spaced a distance $L_1$ from the aperture 18. This distance $L_1$ must be greater than the distance $L_2$ between the front end of the body 1 and the writing tip 3 of the reservoir 2 when the latter is in the retracted position. The length of the clearance slot 15 in the body 1 is somewhat more than the distance $L_2$.

As has been mentioned, the catch 7 is arranged not on the front end of the pocket clip 5 but in a position spaced backwardly therefrom; in other words, the clip extends forwardly beyond the catch 7. This forwardly extending part of the pocket clip 5 is sufficiently long to conceal the aperture 18 even when the reservoir 2 is in the retracted position as in FIG. 1.

FIG. 7 also clearly indicates a recessed guide track 19 formed in the outer surface of the body 1. The recessed guide track 19 extends rearwardly from the aperture 18 and in line with the clearance slot 15. The catch 7 is to slide on and along this recessed guide track 19 with the travel of the reservoir 2 between the retracted and the writing position.

It will be further observed from FIG. 7 that the body 1 has a guide slot 16 extending between its rear end and the clearance slot 15. The guide slot 16 slidably receives a guide fin 14, FIGS. 4 and 5, formed longitudinally on the push button 6. The push button 6 is therefore restrained from rotary displacement relative to the body 1 during the travel of the reservoir 2 between the retracted and the writing position.

The guide slot 16 is open not only to the back of the body 1 but also, via a constriction 17, to the rear end of the clearance slot 15. The constriction 17 has a width less than the dimension of the fulcrum 10 as measured in the transverse of the clearance slot 15. Therefore, with the insertion of the push button 6 in the body 1, the fulcrum 10 can be directed into the clearance slot 15 through the guide slot 16 and constriction 17, it being understood that the body 1 is capable of elastic deformation to permit forced passage of the fulcrum 10 through the constriction. Once the fulcrum 10 is received in the clearance slot 15, the constriction 17 serves the purpose of confining the fulcrum therein.

OPERATION

The retraction mechanism 4 comprising the pocket clip 5 and the push button 6 may be preassembled as show in FIG. 4, before being inserted in the body 1 with the reservoir 2. An inspection of this figure will reveal that the pocket clip 5 does not extend parallel tot he axis of the push button 6 but slants toward the push button as it extends forwardly. Consequently, when the retraction mechanism 4 is mounted to the body 1 as shown in FIG. 1, with the reservoir 2 in the retracted position, both cantilever 12 and compression spring 13 become preloaded to urge the catch 7 against the body 1.

In use the push button 6 may be pressed against the force of the compression spring 20 until the catch 7 falls into the aperture 18 in the body 1 under the forces of the preloaded cantilever 12 and compression spring 13. The catch 7 will positively engage the body 1 as the pair of shoulders 7*a* of the catch butt on the pair of edges 18*a* of the body bounding the aperture 18. The reservoir 2 has now been locked in the writing position of FIG. 2, with its tip 3 projecting a required distance out of the front end opening 1*a* of the body 1. The catch 7 will firmly remain engaged in the aperture 18 during subsequent writing with this instrument as the spring 20 urges the reservoir 2 backwardly with respect to the body 1.

The guide fin 14 on the push button 6 will slide along the guide slot 16 in the body 1 during such travel of the reservoir 2 from the retracted to the writing position. Accordingly, the fulcrum 10 need not perform the additional function of preventing the rotary displacement of the push button 6 by sliding along the edges of the body defining the clearance slot 15. Being less subject to frictional wear than its conventional counterpart, the fulcrum 10 will gain a longer useful life than heretofore.

Also, during the travel of the reservoir 2 from the retracted to the writing position, the catch 7 on the pocket clip 5 will slide over the recessed guide track 19 on the body 1. The catch 7 can thus be positively guided to the aperture 18. There is practically no possibility of the pocket clip 5 undergoing angular displacement about the fulcrum 10.

For retracting the reservoir 2 the rear end portion of the pocket clip 5 may be pressed as indicated by the arrow in FIG. 2. Thereupon the pocket clip 5 will pivot about the fulcrum 10, with the consequent withdrawal of the catch 7 out of the aperture 18. The reservoir 2 will then retract back to the FIG. 1 position under the action of the compression spring 20.

SECOND FORM

FIGS. 8–11 show a slight modification of the FIGS. 1–7 embodiment. The modified writing instrument features a pair of projections 21 formed on the body 1 in substitution for the aperture 18 of the preceding embodiment.

Figure 10:
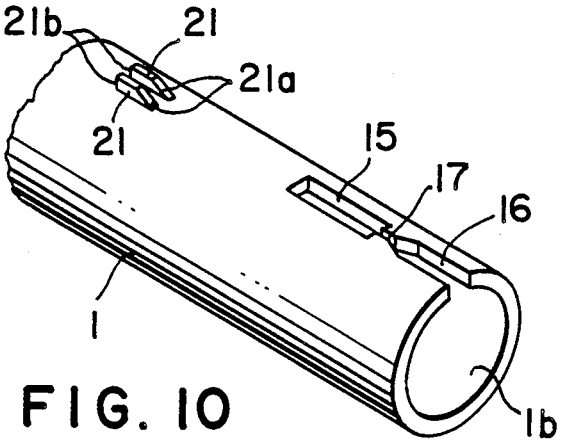
FIG. 10 is a fragmentary perspective vie of the body of the writing instrument of FIG. 8.
Figure 11:
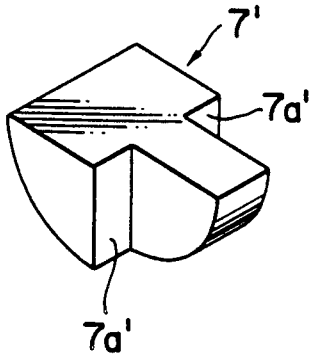
FIG. 11 is an enlarged perspective view of the catch of the writing instrument of FIG. 8.

As best pictured in FIG. 10, the pair of projections 21 are spaced from each other in the circumferential direction of the body 1. Each projection 21 has a gently sloping rear edge 21*a* and a front edge 21*b* extending radially of the body 1. A catch 7' for engagement with the projections 21 can be analogous in shape with the catch 7 of the preceding embodiment, having a pair of shoulders 7*a* on both sides of a semicircular body, as illustrated in FIG. 11.

The modified writing instrument including the retraction mechanism 4 can be identical in the other details of construction with that of FIGS. 1–7. The various parts of the modified writing instrument are therefore indicated by the same reference characters as used to denote the corresponding parts of the FIGS. 1–7 device.

In operation the catch 7' on the pocket clip 5 will ride over the sloping edges 21*a* of the projections 21 when the push button 6 is pressed to move the reservoir 2 from the retracted to the writing position against the force of the compression spring 20. Then, when the reservoir 2 arrives at the writing position shown in FIG. 9, the catch 7' will positively engage the projections 21 as the shoulders 7*a* of the catch butt on the front edges 21*b* of the projections.

Figure 9:
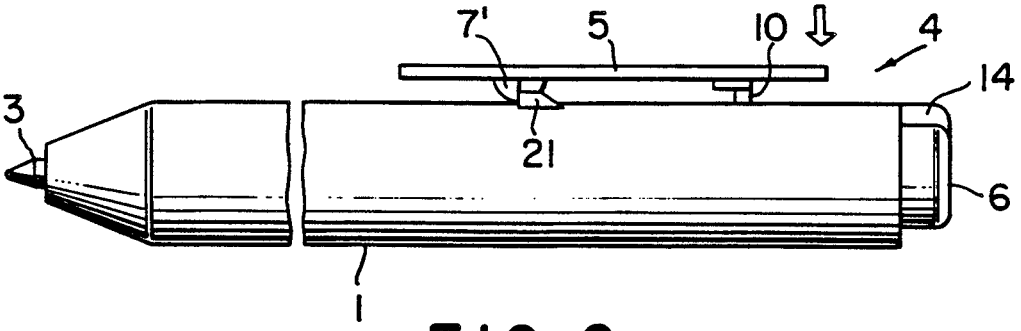
FIG. 9 is a side elevation of the writing instrument of FIG. 8, with the reservoir in the writing position.

The rear end portion of the pocket clip 5 may be pressed, as indicated by the arrow in FIG. 9, to cause retraction of the reservoir 2. Then, with the pivotal movement of the clip about the fulcrum 10, the catch 7' will disengage and ride back over the projections 21, permitting the reservoir 2 to be sprung back to the retracted position of FIG. 8.

THIRD FORM

Figure 12:
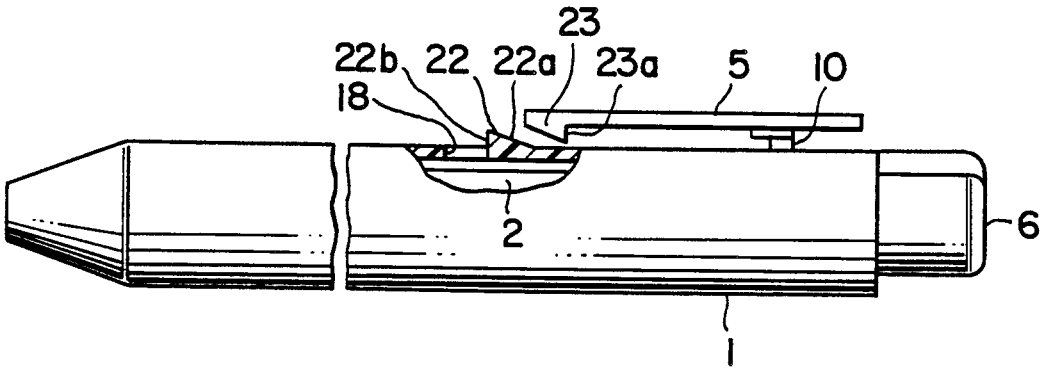
FIG. 12 is a side elevation, partly shown broken away for clarity, of still another preferred form of writing instrument according to the invention, with the reservoir shown in the retracted position.
Figure 13:
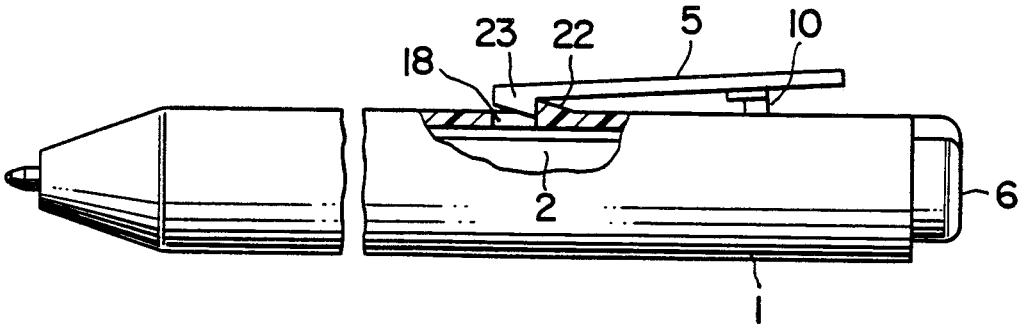
FIG. 13 is a view similar to FIG. 12 except that the reservoir is shown in the writing position.
Figure 14:
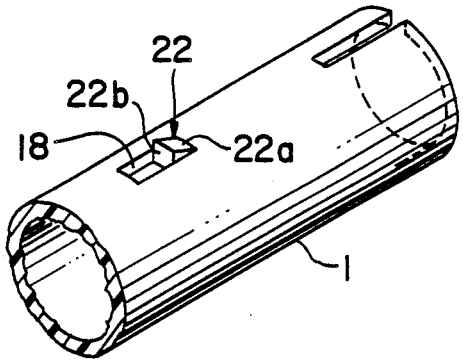
FIG. 14 is a fragmentary perspective view of the body of the writing instrument of FIG. 12.

The third form of writing instrument shown in FIGS. 12–14 is designed to produce a clearly audible click when the reservoir is locked in the writing position, so that the user may find a greater pleasure in using the instrument. The body 1 of this writing instrument has the aperture 18 formed therein and has additionally formed thereon a projection 22 disposed contiguous to, and at the back of, the aperture 18. The projection 22 has a sloping rear surface 22*a* and a nonsloping front surface 22*b* extending radially of the body 1.

The pocket clip 5 has a catch 23 of modified shape formed on its end away from the fulcrum 10. The catch 23 has a nonsloping rear surface 23*a* for engagement with the nonsloping front surface 22*b* of the projection 22. This writing instrument can be similar in the other details of construction to that shown in FIGS. 1–7.

In operation the catch 23 will ride over the sloping rear surface 22*a* of the projection 22 as the reservoir 2 travels from the retracted position of FIG. 12 to the writing position of FIG. 13. Then, at the writing position, the catch 23 will fall form the acute-angled crest of the projection 22 into the aperture 18. A sharp click will be generated as the rear surface 23*a* of the catch 23 comes impulsively into abutment against the nonsloping surface 22*b* of the projection 22.

FOURTH FORM

Figure 17:
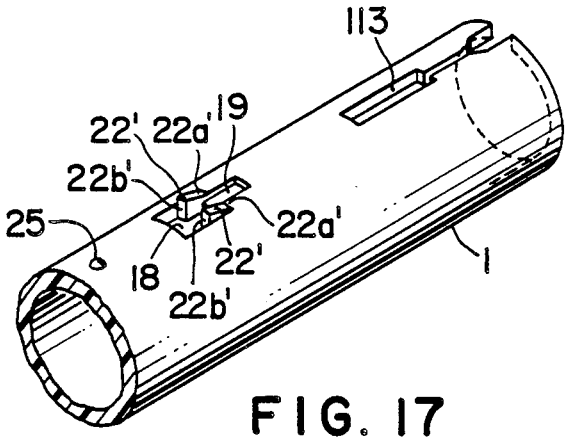
FIG. 17 is a fragmentary perspective view of the body of the writing instrument of FIG. 15.
Figure 15:
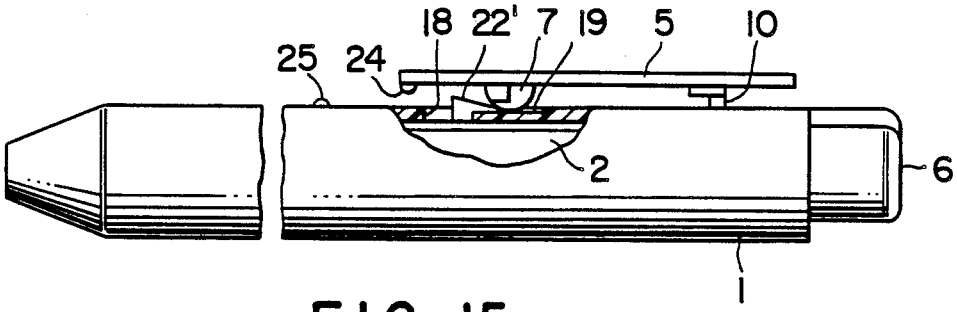
FIG. 15 is a side elevation, partly shown broken away for clarity, of a further preferred form of writing instrument according to the invention, with the reservoir shown in the retracted position.
Figure 16:
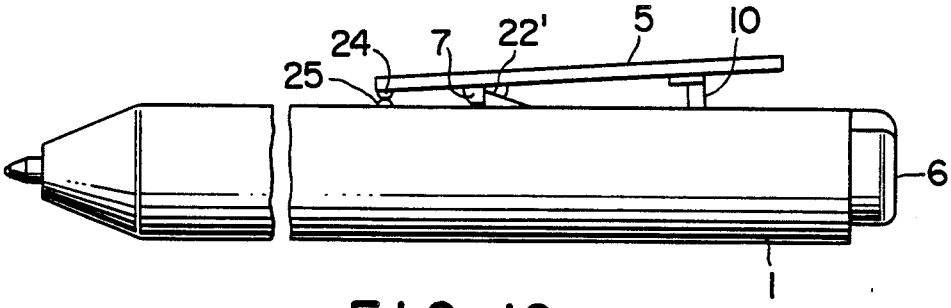
FIG. 16 is a view similar to FIG. 15 except that the reservoir is in the writing position.

In FIGS. 15–17 is shown an additional form of writing instrument also designed to produce a click when the reservoir is locked in the writing position. This writing instrument features a pair of projections 22' formed on the body 1 and disposed just at the back of the aperture 18 in substitution for the single projection 22 of the FIGS. 12–14 embodiment. The pair of projections 22' are spaced from each other in the circumferential direction of the body 1. Each projection 22' has a sloping rear surface 22*a'* and a nonsloping front surface 22*b'* extending radially of the body 1. The recessed guide track 19 extends rearwardly from between the pair of projections 22', for the same purposes as set forth in connection with the FIGS. 1–7 embodiment.

The catch 7 of the same construction as that shown in FIG. 6 is formed on the pocket clip 5 in a position somewhat spaced from its front end. Additionally, the pocket clip 5 has a stud 24 of metal or like hard material formed on its front end. Another similar stud 25 is formed on the body 1, in such a position thereon that the stud 24 on the pocket clip 5 hits the stud 25 on the body 1 when the reservoir 2 is locked in the writing position as in FIG. 16. Typically, both studs 24 and 25 take the form of metal balls partly embedded respectively in the pocket clip 5 and in the body 1.

In this embodiment, too, the catch 7 will plunge into the aperture 18 by riding off the acute-angled crests of the projections 22' upon depression of the push button 6. A click will therefore be produced as the pair of shoulders of the catch 7 hit the nonsloping front surfaces 22*b*'of the projections 22'. A click will also be generated as the stud 24 on the pocket clip 5 strikes the stud 25 on the body 1. The clicks created simultaneously by the two different sources will be more clearly audible than that generated by either source.

An advantage of the additional use of the studs 24 and 25 in this embodiment is that the tone of the click is controllable by changing the material, shape or size of the studs. Of course, these studs could be employed in combination with the projection 22 of FIGS. 12–14.

What is claimed is:

1. A retraction mechanism for a retractable-tip writing instrument of the type having a reservoir which is mounted within a substantially tubular body for movement between a writing and a retracted position and which is sprung with respect to the body from the writing toward the retracted position, the retraction mechanism comprising:

(a) a push button affixed to the reservoir for joint movement therewith between the writing and the retracted position relative to the body;

(b) a cantilever of resilient material secured at one end to the push button and extending longitudinally of the body;

(c) a fulcrum formed on another end of the cantilever and extending through a clearance slot formed longitudinally in the body;

(d) a pocket clip formed on the fulcrum and disposed outside the body; and (e) a catch formed on the pocket clip and urged against the body by virtue of the resiliency of the cantilever, the catch being capable of positive engagement with the body when the push button is pressed to move the reservoir form the retracted to the writing position.

2. The retraction mechanism of claim 1 further comprising a spring mounted to the push button and coacting with the cantilever to urge the catch against the body via the pocket clip.

3. The retraction mechanism of claim 1 further comprising a guide formed on the push button and slidably engaged in a guide slot formed in the body for guiding the travel of the reservoir between the writing and the retracted position.

4. The retraction mechanism of claim 3 wherein the guide slot is in line with the clearance slot and is joined thereto via a constriction.

5. The retraction mechanism of claim 1 wherein the push button and the cantilever and the fulcrum are of one-piece construction.

6. The retraction mechanism of claim 1 wherein the body has an aperture defined therein, and wherein the catch on the pocket clip positively engages the body by falling into the aperture when the reservoir is moved from the retracted to the writing position.

7. The retraction mechanism of claim 6 wherein the body has formed therein a recessed guide track extending longitudinally of the body and joined to the aperture, the catch on the pocket clip traveling along the recessed guide track with the movement of the reservoir between the retracted and the writing position in order to prevent the angular displacement of the pocket clip about the fulcrum.

8. The retraction mechanism of claim 1 wherein the body has formed thereon a pair of projections spaced from each other in the circumferential direction of the body, and wherein the catch on the pocket clip rides over the projections during the travel of the reservoir from the retracted to the writing position, and positively engages the projections when the reservoir arrives at the writing position.

9. The retraction mechanism of claim 1 wherein the body has an aperture defined therein and has formed thereon a projection disposed contiguous to the aperture, and wherein the catch on the pocket clip positively engages the body by falling into the aperture after riding over the projection when the reservoir is moved form the retracted to the writing position, so that a click is produced when the catch falls into the aperture.

10. The retraction mechanism of claim 9 further comprising a first stud mounted to the body, and a second stud mounted to the pocket clip, the second stud striking the fist stud, with the consequent production of a click, when the catch on the pocket clip falls into the aperture in the body.

11. The retraction mechanism of claim 1 wherein the body has an aperture defined therein and has formed thereon a pair of projections spaced from each other int he circumferential direction of the body and disposed contiguous to the aperture, and wherein the catch on the pocket clip engages the projections by falling into the aperture after riding over the projections when the reservoir is moved from the retracted to the writing position, so that a click is produced when the catch falls into the aperture.

12. The retraction mechanism of claim 11 wherein the body has formed therein a recessed guide track extending longitudinally of the body, the catch on the pocket clip traveling along the recessed guide track before riding on the pair of projections on the body with the movement of the reservoir from the retracted to the writing position in order to prevent the angular displacement of the pocket clip about the fulcrum.

* * * * *